US006222455B1

(12) United States Patent
Kaiser

(10) Patent No.: US 6,222,455 B1
(45) Date of Patent: Apr. 24, 2001

(54) MULTI-FUNCTIONAL SMOKE DETECTOR AND SIGNAL DEVICE

(76) Inventor: Richard A. Kaiser, N84 W28518 Center Oak Rd., Hartland, WI (US) 53029

( * ) Notice: Subject to any disclaimer, the term of this patent is extended or adjusted under 35 U.S.C. 154(b) by 0 days.

(21) Appl. No.: 09/594,536

(22) Filed: Jun. 14, 2000

(51) Int. Cl.[7] ..... G08B 17/10

(52) U.S. Cl. ..... 340/628; 340/577; 340/584; 340/691.4

(58) Field of Search ..... 340/628, 629, 340/630, 577, 578, 579, 584, 691.1, 691.4, 693.5

(56) References Cited

U.S. PATENT DOCUMENTS

| | | | | |
|---|---|---|---|---|
| 4,148,023 | | 4/1979 | Elkin . | |
| 4,227,191 | | 10/1980 | Raber . | |
| 4,258,291 | | 3/1981 | Scott et al. . | |
| 4,419,658 | * | 12/1983 | Jarosz et al. | 340/521 |
| 4,438,428 | * | 3/1984 | Ober et al. | 340/628 |
| 4,484,181 | * | 11/1984 | Schwartz | 340/521 |
| 4,489,308 | | 12/1984 | Logan, Jr. et al. . | |
| 4,525,703 | * | 6/1985 | Bellino | 340/628 |
| 4,612,535 | | 9/1986 | Sequin et al. . | |
| 4,717,910 | | 1/1988 | Scripps et al. . | |
| 5,140,310 | | 8/1992 | Watanabe . | |
| 5,177,461 | | 1/1993 | Budzyna et al. . | |
| 5,745,040 | | 4/1998 | Loughridge . | |
| 5,886,637 | | 3/1999 | Stuckey . | |
| 6,114,948 | * | 9/2000 | Astell | 340/628 |

* cited by examiner

*Primary Examiner*—Daniel J. Wu
(74) *Attorney, Agent, or Firm*—Andrus, Sceales, Starke & Sawall

(57) ABSTRACT

A smoke detector and signal device is adapted for attachment to an interior door knob or to the window of a room. The device includes a housing containing an interconnected array of components including a smoke responsive transducer, an electric power source, a signal light, and an electronic circuit device interconnecting the array of components. The device includes connectors for either attaching the housing to the window for displaying the signal light to the outside or to the door knob of the room to provide a lighted signal of the precise location of the door knob to an occupant within the room.

14 Claims, 4 Drawing Sheets

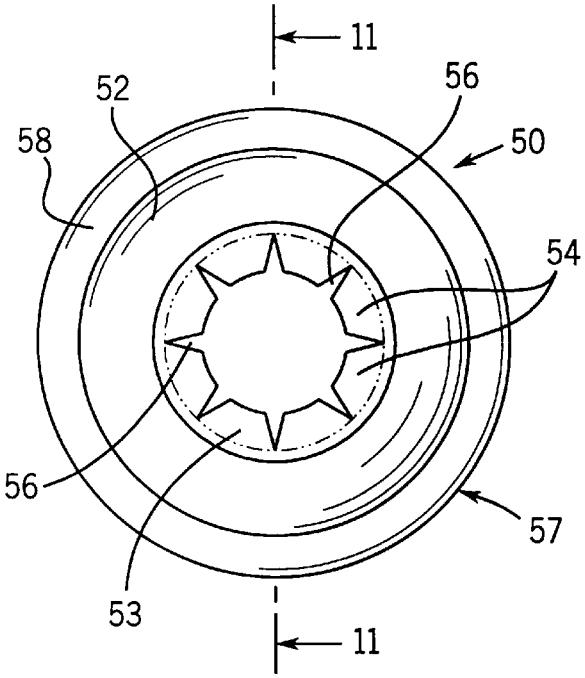
FIG. 10
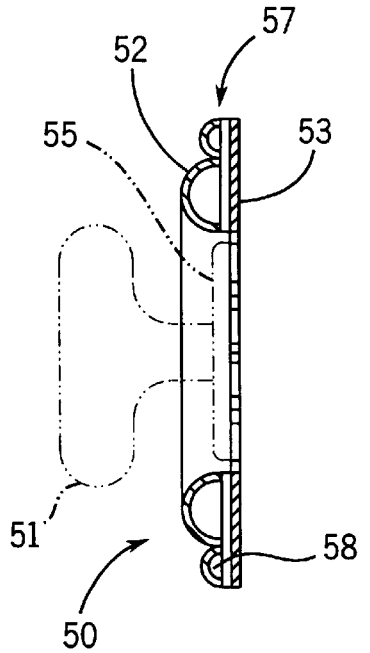
FIG. 11
FIG. 9
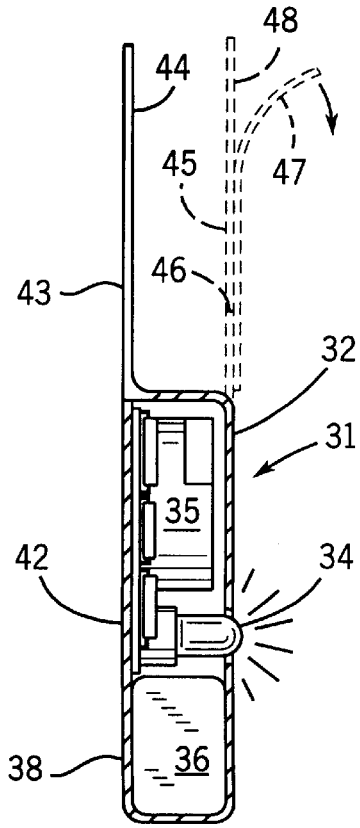

MULTI-FUNCTIONAL SMOKE DETECTOR AND SIGNAL DEVICE

BACKGROUND OF THE INVENTION

The present invention relates to a smoke detector for use in protecting occupants of a building and, more particularly, to a smoke detector signal light device which when activated will show the location of a door knob to the occupant of a room or, more particularly, to the location of an occupied room through a window to fire or rescue personnel on the outside.

Smoke detectors are most commonly operatively connected to an audible alarm to provide a signal of smoke and/or a fire to the occupants of a building. It is also known to operatively connect a light to a smoke alarm. U.S. Pat. Nos. 4,148,023 and 4,717,910 disclose smoke detectors that include built-in emergency lights, as well as the usual audible alarm. U.S. Pat. Nos. 4,227,191, 4,258,291, 4,489,308 and 5,140,301 all describe smoke alarm-activated lights which illuminate or show the location of a door to the occupant of a building. Finally, U.S. Pat. No. 5,886,637 discloses a smoke detector built into the upper edge of a door that includes a signal light and an audible alarm.

None of the foregoing patents, however, disclose or suggest the use of a smoke alarm and signal light in direct association with a door knob or similar door operator to pinpoint the location thereof to an occupant.

U.S. Pat. No. 5,177,461 describes a window-mounted signal light that can be observed from outside the building that is activated by a smoke detector including an audible alarm housed in a conventional ceiling-mounted unit separate from the lighted signaled device. U.S. Pat. No. 4,612,535 describes an outdoor audible alarm that is activated by a separate indoor smoke detector. U.S. Pat. No. 5,745,040 describes an exterior audible and visible signaling device that is activated by a smoke alarm inside the building.

The foregoing prior art, however, does not show or suggest a unitary smoke detector and lighted signal device that can be attached to a window to provide a lighted indication of the presence of a building occupant to fire or rescue personnel on the outside.

SUMMARY OF THE INVENTION

In accordance with the present invention, a unitary smoke detector and signal light device is attachable to or directly adjacent a door knob or a window of a room to provide a lighted signal showing the location of the door knob or to display through the window to the exterior of the building a signal light indicative of room occupancy.

In accordance with one embodiment of the invention, a unitary smoke detector and signal device is particularly adapted to use on in direct association with a manual operator for a door. This device includes a housing that is mounted on the door operator, the housing having mounted therein an interconnected array of components that include a smoke responsive transducer, a replaceable electric power source, a signal light, and an electric circuit device that operatively interconnects the components of the array. The signal light is particularly adapted to provide an occupant of the building with a visual indication of the exact location of the door.

In one embodiment, a door knob comprises the housing for the device. The door knob includes a removable cover that provides access to the array of components therein. Preferably, the cover is centered on the outer face of the knob and the signal light is mounted in the cover.

In another embodiment, for use of a door operator that includes a cover plate, the housing comprises an annular body having an open interior lined by a radial mounting flange and the flange is dimensioned to be captured behind the cover plate to secure the device in plate. The mounting flange may comprise a continuous annular flange or a plurality of circumferentially spaced tabs.

In any of the foregoing embodiments, the array of components may include an audible alarm. For use with a door operator comprising a conventional door knob or latch-type handle, the housing may include an open attachment ring permitting the housing to be removably hung from the door knob.

In accordance with another embodiment, the smoke detector and signal device is especially adapted for demountable attachment to either a door knob or to a window of a room. The device includes a housing having mounted therein an interconnected array of components, including a smoke responsive transducer, an electric power source, a signal light, and an electronic circuit that operatively interconnects the array of components. Means are provided for demountably attaching the housing to either of the window for displaying the signal light therethrough or the door knob for lighted signaling of the location thereon. The attaching means preferably comprises a hanger attached to the housing for suspending the device from the door knob. In a particularly preferred embodiment, the housing includes a flat enclosing wall and the hanger comprises a flat hanger strip that extends from and is generally coplanar with the flat enclosing wall. The hanger strip includes an aperture to receive the door knob and may also include a mounting face to which is applied an exposable adhesive surface layer for attachment to a window or other surface.

BRIEF DESCRIPTION OF THE DRAWINGS

FIG. 9 is a side elevation view of FIG. 7, modified slightly to show an alternate embodiment.

FIG. 10 is a front elevation view of another embodiment of the invention.

FIG. 11 is a sectional view taken on line 11—11 of FIG. 10 and showing in phantom its adaptation mounting on a door knob.

DETAILED DESCRIPTION OF THE PREFERRED EMBODIMENTS

Figure 1:
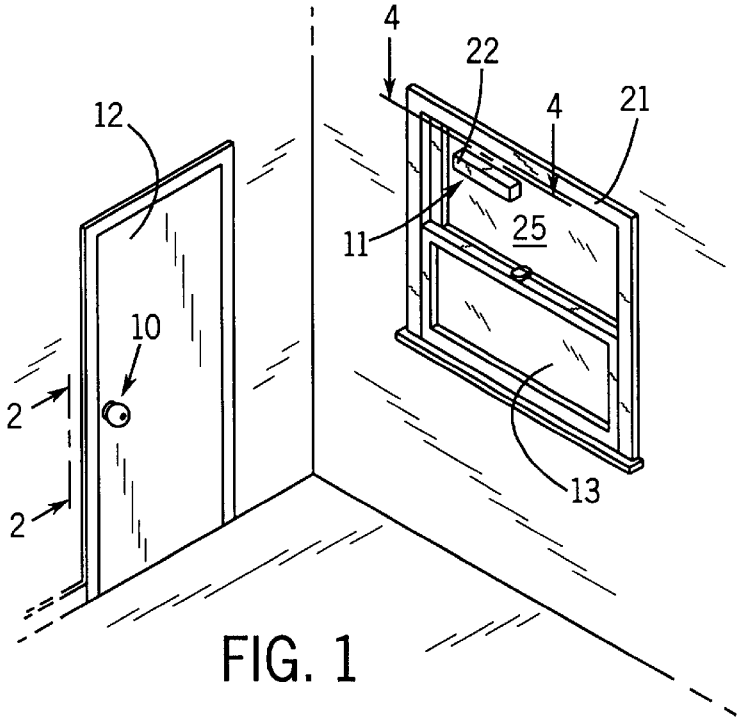
FIG. 1 is a perspective view of the interior of a room showing embodiments of the invention on a door knob and on a window.

As shown in FIG. 1, one embodiment of the invention comprises a smoke detector and signal light device built into a door knob 10 to provide a visual signal of the exact location of the door knob when activated by the detection of smoke within the room. In another embodiment, a window mounted detector and signal device is mounted directly on a window 13 and oriented to direct a lighted signal of room occupancy to rescue personnel on the outside. In another embodiment to be described hereinafter, a single unitary smoke detector and lighted signal device can be demountably attached to either a door knob or to a window to provide the respective signaling functions described above.

Figure 2:
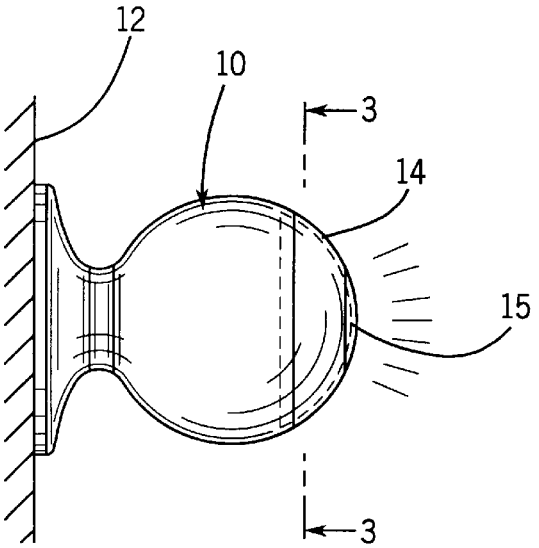
FIG. 2 is an enlarged side elevation in detail taken on line 2—2 of FIG. 1.
Figure 3:
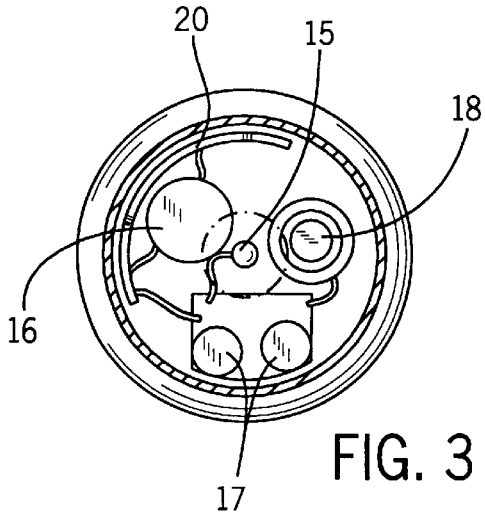
FIG. 3 is a vertical sectional view taken on line 3—3 of FIG. 2.

Referring also to FIGS. 2 and 3, in this embodiment the detector and signal device utilizes a door knob 10 for the housing. The knob 10 includes a removable cover 14 in the center of which is mounted a signal light 15. The interior of the knob 10 houses an array of the other components comprising a detector and signal device, namely, a smoke detector module 16 comprises a conventional smoke responsive transducer, one or more batteries 17, and, optionally, an audible alarm 18 in the form of a small speaker. A small electronic circuit board operatively interconnects the array of components, including the signal light 15, such that the detection of smoke in the room will cause the light to be illuminated, thereby providing an exact indication of the location of the door knob 10. If the optional alarm speaker 18 is included, it is activated simultaneously with the light 15.

Figure 4:
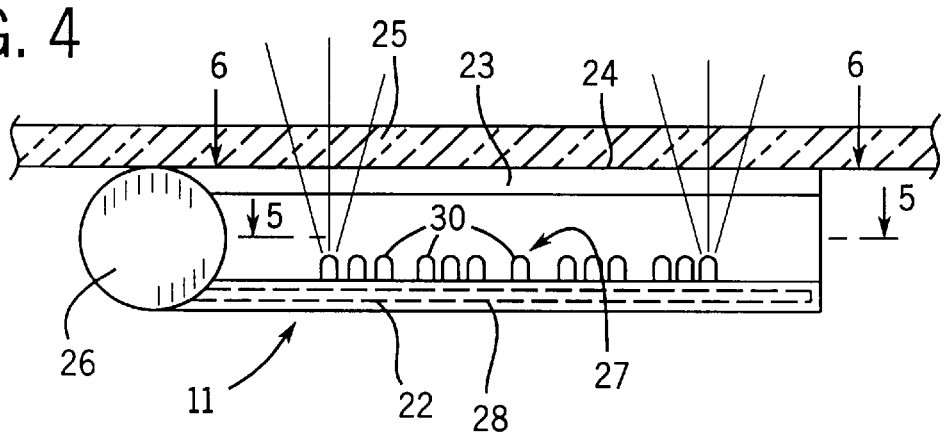
FIG. 4 is a plan view partly in section taken on line 4—4 of FIG. 1.
Figure 5:
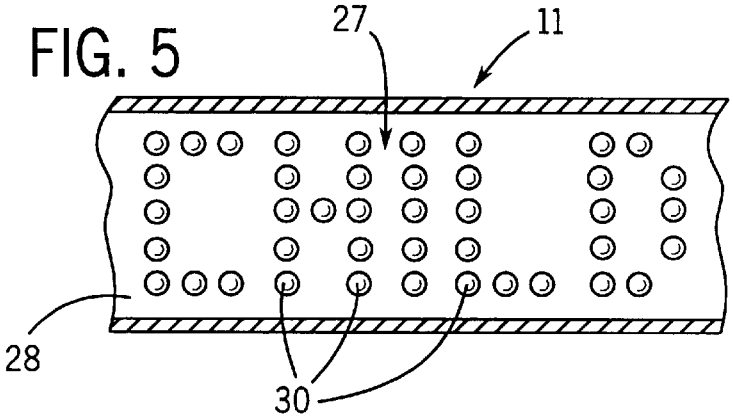
FIG. 5 is a sectional detail taken on line 5—5 of FIG. 4.
Figure 6:
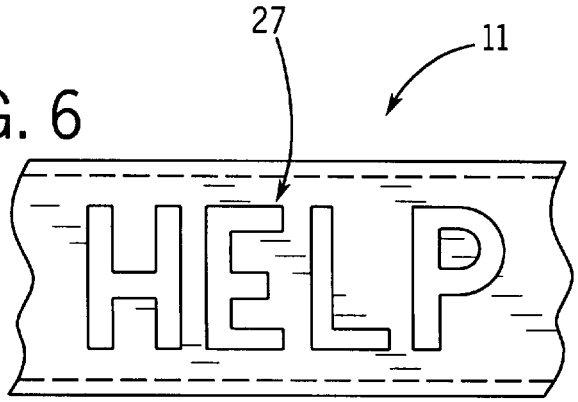
FIG. 6 is a detail of an alternate embodiment taken line 6—6 of FIG. 4.

In FIGS. 4–6, details of the window mounted detector and signal device 11 are shown. The detector and signal device 11 may be attached to the window casing 21. Alternately, the housing 22 for the device includes a transparent front wall 23 over which an exposable transparent adhesive layer may be applied such that the device may be attached directly to the window pane 25. One edge of the housing 22 includes an enclosure 26 for all of the components of the device, except for a lighted signal 27. The lighted signal is mounted on a housing back wall 28 and preferably includes an array of LEDs 30 or other low power lights. All of the remaining components, including a smoke transducer, batteries, circuit device, and audible alarm (if used) are contained in the small enclosure 26. The LEDs 30 are electrically connected to the batteries and circuit device with suitable wiring contained in the back wall 28.

The lighted signal 27 which is visible outside the building through the transparent front wall 23 and window pane 25 may be in the form of a displayed message. As shown in FIG. 5, the message provided by the lighted signal 27 may be an indication that a "child" is present in the room. Alternately, as shown in FIG. 6, the lighted signal 27 may be in the form of a "help" signal. The combination of the interior door knob-mounted device 10 and the window mounted device 11 provides assistance to the occupant of the room to directly locate the exit door 12 and to fire or rescue personnel on the outside precisely to locate the window 13 of the room occupied by a particular person, in particular, a child.

Figure 7:
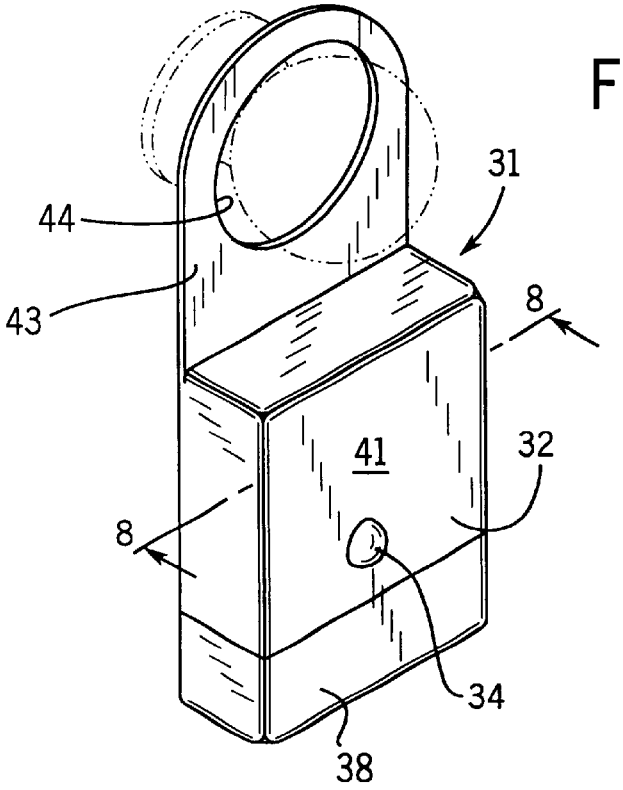
FIG. 7 is a front elevation view of another embodiment of the smoke detector and signal device of the present invention.
Figure 8:
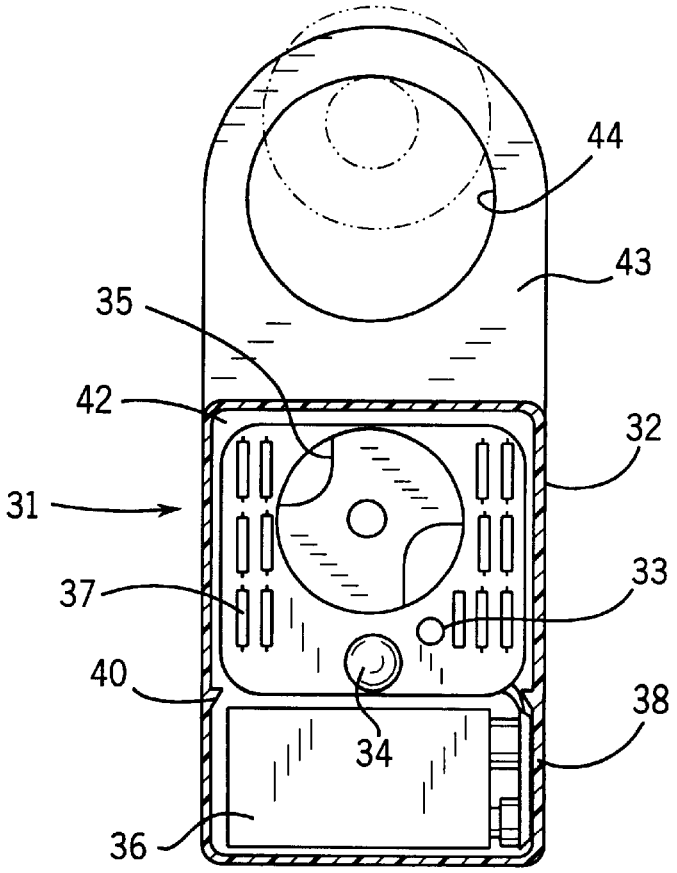
FIG. 8 is a perspective view showing the FIG. 7 device on a door knob.

FIGS. 7–9 show another embodiment of the invention in the form of a dual use detector and signal device 31 which may be hung on a door knob, suspended from the window casing 21, or modified slightly to be adhesively attached directly to the window pane 25. The detector and signal device 31 includes a housing for all of the components, including a smoke responsive transducer 33, a signal light 34, an audible alarm 35, a battery 36 and a circuit device 37 interconnecting the array of components. The battery 36 may be enclosed in a removable cover 38 attached to the remainder of the housing 32 with a simple resilient connection 40 of the type well known in the art. Thus signal light 34 protrudes through or is visible through the front wall 41 of the housing 32. The rear wall 42 of the housing includes a planar upper extension 43 provided with an aperture 44 large enough to fit over the door knob so the device 31 may be easily hung thereon.

A slightly modified version of the embodiment is shown in dashed lines in FIG. 9. The upper extension 43 from the rear wall 42 may be replaced with an alternate upper extension 45 formed integrally with the front wall 41. The alternate extension surface 45 may be provided with an aperture 46 for hanging the unit on a door knob and, in addition, is provided on its front face with a peel-off paper layer 47 beneath which is an exposable adhesive layer 48 to accommodate direct attachment of the device 31 to a window pane 25. The signal light 34 is thus visible through the window to the outside of the dwelling and an optional audible alarm 35 provides a smoke signal to the occupant inside.

In FIGS. 10 and 11, there is shown compact smoke detector and signal device 50 that is particularly suitable for mounting on a door knob 51 where it is not suitable to use the interior of the knob as in the device 10 of FIGS. 2 and 3. If the door knob is used to house the components of a lock set or other locking device, or for esthetic reasons the door knob cannot be replaced, the device 50 provides an alternate means of mounting and a display that is somewhat less intrusive than the previously described embodiments.

The detector and signal device 50 includes a circular housing 52 within which an array of operating components such as those described with respect to the previous embodiments is housed. The interior of the circular housing 52 is open and defined by a thin mounting flange 53. The flange may be continuous or, as shown in FIG. 10, may comprise a circumferential array of truncated sectors 54. The cover plate 55 associated with the door knob 51 is loosened and the flange 53 is inserted behind the cover plate, after which the cover plate may be again secured in position. The open slots 56 between the sectors 54 provide flexibility to allow the flange to be easily positioned and may also provide clearance for screws or other fasteners associated with the cover plate 55.

The outer peripheral edge of the housing 52 includes an annular signal light 57 that is preferably in the form of a light pipe 58 providing a solid ring of light around a door knob 51 when the smoke detector is activated. As with the other embodiments of the invention described herein, the audible alarm may be eliminated in which case an audible alarm signal to the room occupant would be provided by another device, such as a conventional ceiling or wall mounted smoke detector.

I claim:

1. A unitary smoke detector and signal device for the door of a building, the door including a manual door operator, said device comprising:

a housing mounted on the door operator;

the housing having mounted therein an interconnected array of components including a smoke responsive transducer, a replaceable electric power source, a signal light, and an electronic circuit device operatively interconnecting said array; and, said signal light providing to an occupant of the building a visual indication of the exact location of the door operator.

2. The device as set forth in claim 1 wherein the door operator includes a door knob and said knob comprises the housing.

3. The device as set forth in claim 2 wherein the knob includes a removable cover providing access to the components therein.

4. The device as set forth in claim 3 wherein the cover is centered on the outer face of the knob and the signal light is mounted on said cover.

5. The device as set forth in claim 1 wherein said door operator includes a cover plate, and said housing comprises an annular body having an open interior defined by a radial mounting flange, said flange dimensioned to be captured behind the cover plate.

6. The device as set forth in claim 5 wherein the mounting flange comprises a continuos annular flange.

7. The device as set forth in claim 5 wherein the mounting flange comprises a plurality of circumferentially spaced tabs.

8. The device as set forth in claim 1 wherein said array of components includes an audible alarm.

9. The device as set forth in claim 1 wherein the door operator comprises a door knob, said housing includes an open attachment ring permitting said housing to be removably hung from the door knob.

10. A smoke detector and signal device for attachment to a door knob or a window of a room, said device comprising:

a housing having mounted therein an interconnected array of components including a smoke responsive transducer, an electric power source, a signal light and an electronic circuit device operatively interconnecting said array; and, means for attaching said housing to one of the window for displaying the signal light therethrough and the door knob for lighted signaling of the location thereof.

11. The device as set forth in claim 10 wherein said attaching means comprises a hanger attached to the housing for suspending the device from the door knob.

12. The device as set forth in claim 11 wherein said housing includes a flat enclosing wall and said hanger comprises a flat hanger strip extending from and generally coplanar with said enclosing wall.

13. The device as set forth in claim 12 wherein said hanger strip includes an aperture sized to receive the door knob.

14. The device as set forth in claim 13 wherein said hanger strip includes a mounting face having an exposable adhesive surface layer thereon.

* * * * *